US007553174B2

(12) United States Patent
Roepke et al.

(10) Patent No.: US 7,553,174 B2
(45) Date of Patent: Jun. 30, 2009

(54) CABLE MANAGEMENT DEVICE CONFIGURED TO SUPPORT ONE OR MORE ELECTRICAL DEVICES AND METHODS OF MANUFACTURING AND USING THE SAME

(75) Inventors: Jon Roepke, Hermosa Beach, CA (US); Kenneth Mori, Los Angeles, CA (US)

(73) Assignee: Belkin International, Inc., Compton, CA (US)

( * ) Notice: Subject to any disclaimer, the term of this patent is extended or adjusted under 35 U.S.C. 154(b) by 2 days.

(21) Appl. No.: 11/866,779

(22) Filed: Oct. 3, 2007

(65) Prior Publication Data

US 2008/0113563 A1 May 15, 2008

Related U.S. Application Data

(60) Provisional application No. 60/849,200, filed on Oct. 3, 2006.

(51) Int. Cl.
*H01R 13/44* (2006.01)

(52) U.S. Cl. ..... 439/136

(58) Field of Classification Search ..... 439/136, 439/142; 174/67, 53, 58, 63
See application file for complete search history.

(56) References Cited

U.S. PATENT DOCUMENTS 5,218,169 A * 6/1993 Riceman ..... 174/67
7,378,591 B2 * 5/2008 Dinh ..... 174/58

OTHER PUBLICATIONS

Sundance Solar; Soldius® Solar Charger for iPod, cellphone, Blackberry; http://store.sundancesolar.com/sosochforipc.html; Sep. 14, 2007; 3 pages.

Enoadoet; Eclipse Solar Flare device-charging messenger bag; http://www.engadget.com/2005/03/15/eclipse-solar-flare-device-charging-messenger-bag/; May 15, 2005; 10 pages.

iPod/Cell Phone/PDA Centralized Portable Charging Station; http://www.welovemacs.com/20150.html; May 15, 2006; 3 pages.

Power Station Traveller™ Power Station with Home Adapter; http://us.st11.yimg.com/us.st.yimg.com/I/lovemacs 1898 9529608; May 15, 2006; 1 page.

The Twister Group; Resource, Inc. 20140 Battery Rack Power Station; http://www.thetwistergroup.com/store/customer/product.php?productid=20140%20W04191&source=fr; May 15, 2006; 2 pages.

Deluxe Electronics Charger Station—Cherry; http://www.amazon.com/Deluxe-Electronics-Charger-Station-Cherry/dp/B000ULKAKE/ref=pd_sbs_op_3/103-6352768-8411061?ie=UTF . . . ; Nov. 17, 2004; 8 pages.

Power Station Charger—Grey; http://www.amazon.com/Resource-POWER-STATION-CHARGER-GREY/dp/B00068UA8S/ref+pd_bbs_ 4/103-6352768-8411061?ie+U . . . ; Apr. 24, 2006; 11 pages.

* cited by examiner

*Primary Examiner*—Jean F Duverne
(74) *Attorney, Agent, or Firm*—Bryan Cave LLP

(57) ABSTRACT

In some embodiments, a cable management device is configured to support one or more electrical devices. The cable management device can include: (a) a housing defining an interior space and having one or more apertures extending from an exterior of the housing to the interior space; and (b) one or more electrical outlets located in the interior space of the housing. The housing can include: (a) a stationary portion with a support mechanism; and a cover hingedly attached to the stationary portion. Other embodiments are disclosed in this application.

27 Claims, 10 Drawing Sheets

CABLE MANAGEMENT DEVICE CONFIGURED TO SUPPORT ONE OR MORE ELECTRICAL DEVICES AND METHODS OF MANUFACTURING AND USING THE SAME

CROSS REFERENCE TO RELATED APPLICATIONS

This application claims priority to U.S. Provisional Patent Application No. 60/849,200, filed Oct. 3, 2006.

FIELD OF THE INVENTION

This invention relates generally to cable management devices, and relates more particularly to cable management devices that provide support for one or more electrical device and methods of manufacturing and using the same.

DESCRIPTION OF THE BACKGROUND

Advances in electronics technology have produced a wide variety of electrical devices that require regular charging of their batteries. Consumers that acquire such devices often find themselves left with a work space plagued with the unpleasant and unsightly confusion created by the number of wires, cords, and cables required by each device. Beyond its unsightly appearance, such a tangle of wires can also be unsafe because kinked wires are more susceptible to failure and because it is difficult to identify a particular cable when it is intertwined with other cables in a disorderly way.

Accordingly, a need exists for a cable management device that allows cords, cables, wires, and the like to be managed, organized, and hidden from view while the electrical device is being stored or charged.

BRIEF DESCRIPTION OF THE DRAWINGS

To facilitate further description of the embodiments, the following drawings are provided in which.

Figure 1:
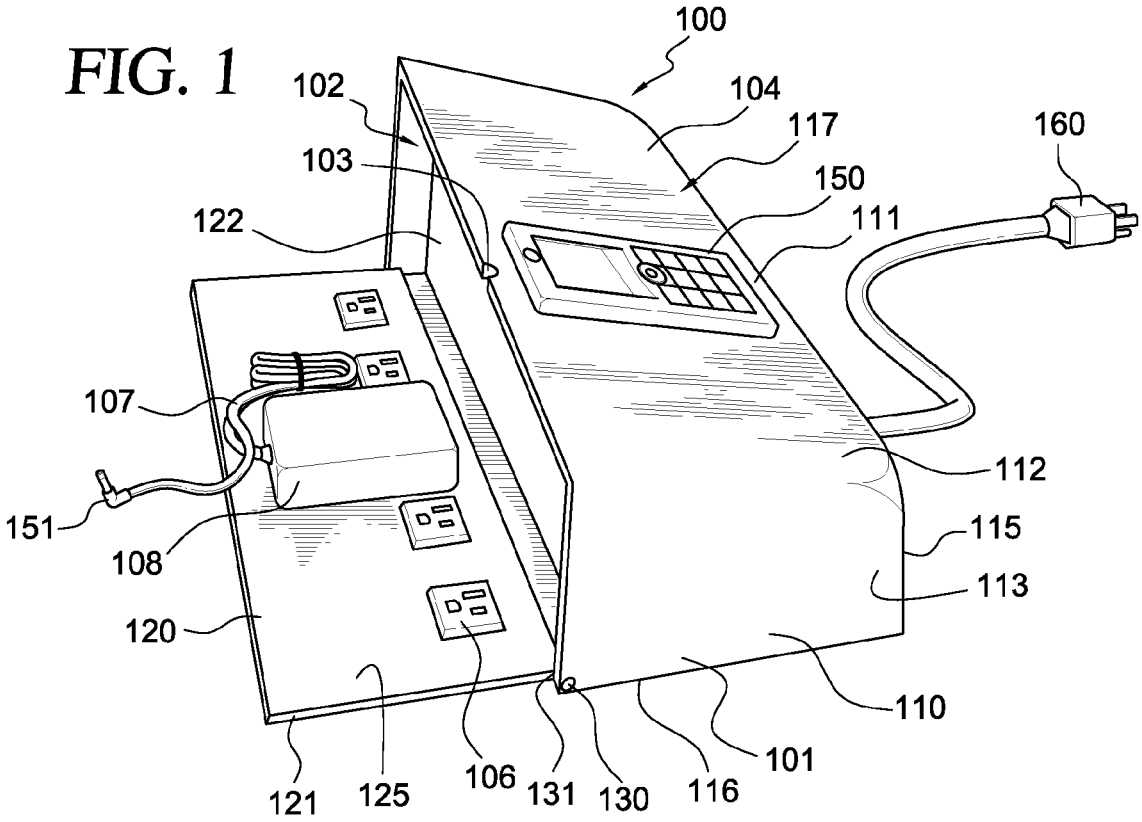
FIG. 1 illustrates a top, side, front isometric view of a cable management device in an open configuration and supporting an electrical device, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under", and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "on," as used herein, is defined as on, at, or otherwise adjacent to or next to or over.

The terms "couple," "coupled," "couples," "coupling," and the like should be broadly understood and refer to connecting two or more elements or signals, electrically and/or mechanically, either directly or indirectly through intervening circuitry and/or elements. Two or more electrical elements may be electrically coupled, either direct or indirectly, but not be mechanically coupled; two or more mechanical elements may be mechanically coupled, either direct or indirectly, but not be electrically coupled; two or more electrical elements may be mechanically coupled, directly or indirectly, but not be electrically coupled. Coupling (whether only mechanical, only electrical, or both) may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling"

and the like should be broadly understood and include mechanical coupling of all types.

The terms "cable," "cables," and the like should be broadly understood to refer to one or more cables, cords, wires, and the like.

DETAILED DESCRIPTION OF EXAMPLES OF EMBODIMENTS

In a number of embodiments, a cable management device is configured to support one or more electrical devices. The cable management device can include: (a) a housing defining an interior space and having one or more apertures extending from an exterior of the housing to the interior space; and (b) one or more electrical outlets located in the interior space of the housing. The housing can include: (a) a stationary portion with a support mechanism; and (b) a cover hingedly attached to the stationary portion. In these embodiments, the support mechanism can support the one or more electrical devices. The cover can be configured to move between a first position, in which the cover substantially encloses the interior space, and a second position, in which the interior space is exposed. The one or more apertures can provide access to the interior space from the exterior of the housing when the cover is in the first position. The housing can be configured such that the cover can be moved between the first position and the second position while the support mechanism maintains support of the one or more electrical devices Other embodiments include a holder for at least one electrical device. The at least one electrical device is coupled to one or more cables. The holder can include: (a) a receptacle defining a cavity, the receptacle including: (1) a first wall with an external surface; (2) a second wall; (3) an L-shaped component; and (4) a hinge; and (b) one or more electrical outlets located in the cavity of the receptacle. In these embodiments, the first wall can be configured to hold the at least one electrical device at the external surface. The hinge can couple the L-shaped component to the second wall such that the L-shaped component and the one or more electrical outlets can be pivoted in relation to the second wall. In these embodiments, the L-shaped component can be pivoted in relation to the second wall such that the receptacle can be placed in a closed arrangement and an open arrangement.

In yet another embodiment, a method of providing a cable management device includes: (a) providing a receptacle with one or more apertures, where providing the receptacle includes: (1) providing a stationary portion configured to support one or more electrical devices; (2) providing a cover; and (3) hingedly attaching the cover to the stationary portion such that the stationary portion can support the one or more electrical devices when the cover is in an open position, and where the cover and the stationary portion define an interior space; and (b) positioning one or more electrical outlets in the interior space such that the one or more electrical outlets can be accessed through the one or more apertures when the cover is in a closed position.

In still other embodiments, a method of providing a holder includes: (a) providing a receptacle including: (1) a first wall configured to hold at least one electrical device at an external surface; and (2) a second wall spaced apart from the first wall; (b) providing an L-shaped component with one or more electrical outlets; and (c) attaching the L-shaped component to the second wall such that the L-shaped component and the one or more electrical outlets can be pivoted in relation to the second wall.

In further embodiments, a method of using a holder includes: (a) using the holder to support an electrical device while the electrical device is being electrically charged; and (b) opening a cover of the holder while the holder continues to support the electrical device and while the electrical device continues to electrically charge.

Figure 2:
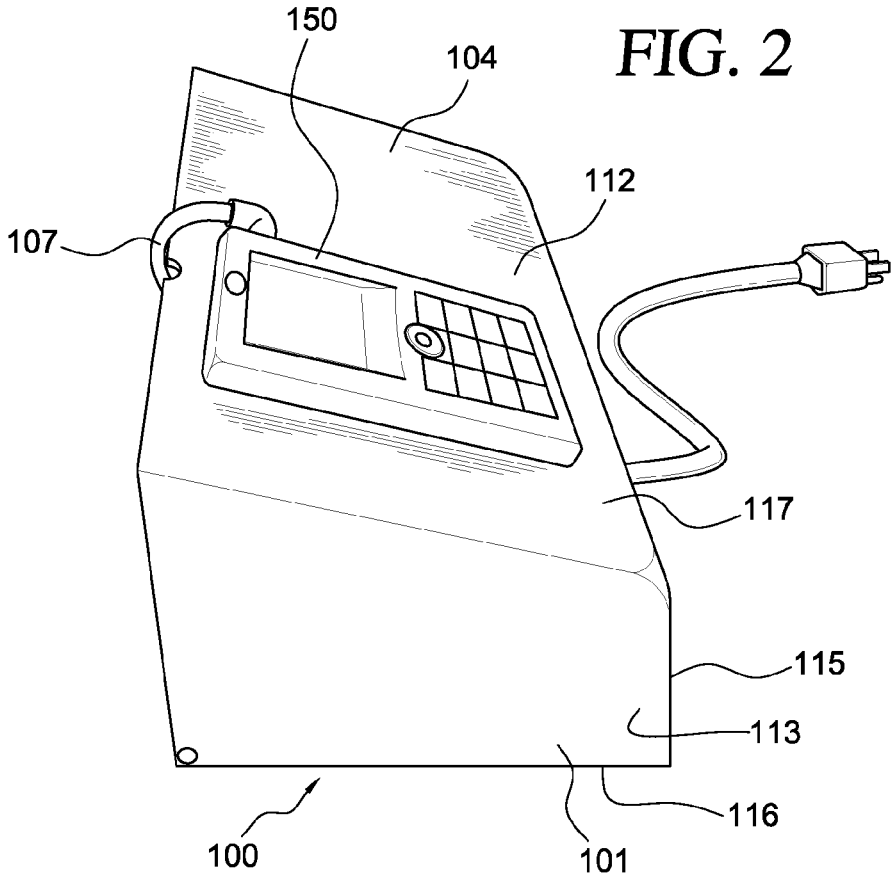
FIG. 2 illustrates a top, side isometric view of the cable management device of FIG. 1 in a closed configuration and supporting the electrical device of FIG. 1, according to the first embodiment.
Figure 3:
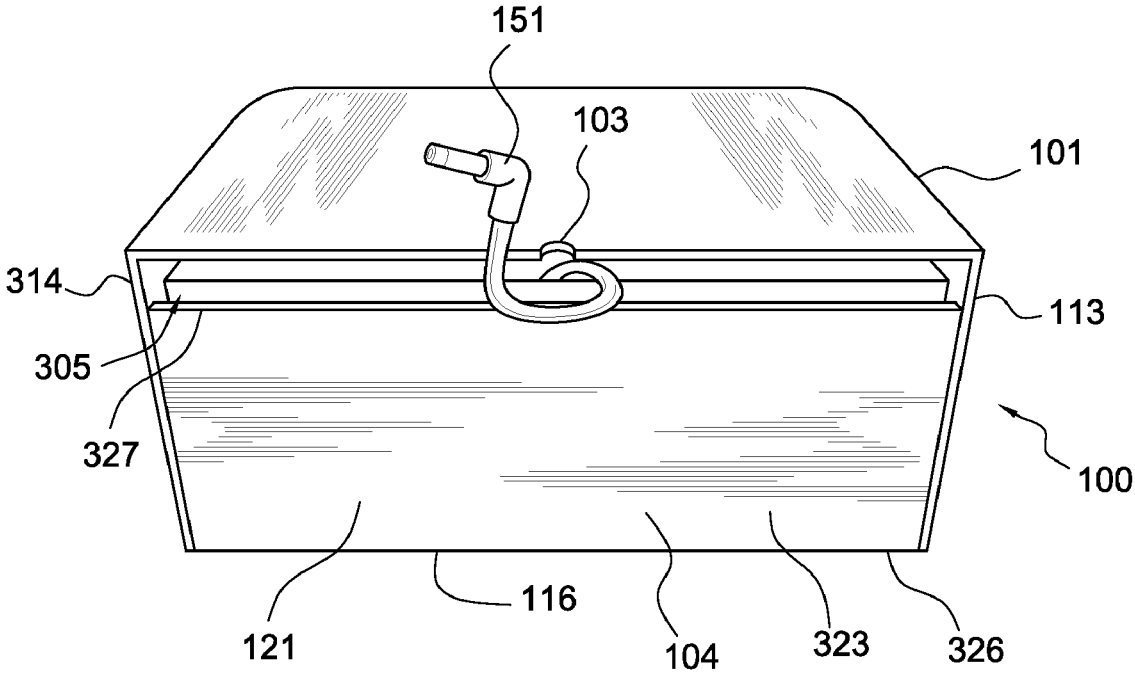
FIG. 3 illustrates a top, front isometric view of the cable management device of FIG. 1 in the closed configuration, according to the first embodiment.

Turning to the drawings, FIG. 1 illustrates a top, side, front isometric view of a cable management device 100 in an open configuration and supporting an electrical device 150, according to a first embodiment. FIG. 2 illustrates a top, side isometric view of cable management device 100 in a closed configuration and supporting electrical device 150, according to the first embodiment. FIG. 3 illustrates a top, front isometric view of cable management device 100 in the closed configuration, according to the first embodiment. Cable management device 100 is merely exemplary and is not limited to the embodiments presented herein. Cable management device 100 can be employed in many different embodiments or examples not specifically depicted or described herein.

In some embodiments, a holder or cable management device 100 for at least one electrical device 150 can include: (a) a receptacle or housing 101 defining a cavity or interior space 102 and having one or more apertures 103 extending from an exterior 104 of housing 101 to interior space 102; (b)one or more electrical outlets 106; and (c) a electrical connector 160 to receive electrical power from an external source and supply the electrical power to electrical outlets 106. Cable management device 100 can be configured to support electrical device 150.

Electrical device 150 can be coupled to at least one cable 107. Cable 107 can have a plug 108 and a connector 151 configured to removably couple electrical device 150. Plug 108 can be removably coupled to one of electrical outlets 106. In some embodiments, plug 108 can be a transformer block. In some embodiments, electrical device 150 can be an electrical device or accessory such as a mobile phone, a personal digital assistant (PDA), a digital music (MP3) player, or the like.

Electrical device 150 can be stored and displayed on housing 101 while the electrical device 150 is electrically charged as shown in FIGS. 1 and 2. When electrical device 150 is stored and displayed on housing 101, plug 108 and a portion of cable 107 can be stored in interior space 102. In non-illustrated examples, more than one electrical device can be stored and displayed on housing 101 and more than one cable and plug can be stored in interior space 102.

In some embodiments, housing 101 can include: (a) a stationary portion 110 with a support mechanism 111 configured to support electrical device 150; (b) a cover 120 coupled to stationary portion 110; and (c) a hinge 130 coupling cover 120 to stationary portion 110. In some examples, cover 120 is coupled to stationary portion 110 by hinge 130 at a junction 131.

Hinge 130 couples cover 120 to stationary portion 110 such that cover 120 and electrical outlets 106 can be pivoted in relation to stationary portion 110. That is, cover 120 is configured to move between a closed configuration (FIGS. 2 and 3), in which housing 101 substantially encloses interior space 102, and an open configuration (FIG. 1), in which interior space 102 is exposed. Housing 101 is configured such that cover 120 can be moved between the open configuration and the closed configuration while support mechanism 111 maintains support for electrical device 150. When housing 101 is in the closed position, cable management device 100 hides plug 108 and a portion of cable 107.

Hinge 130 can be accomplished in any of a variety of ways, including, for example, by using a metal or plastic hinge attached to stationary portion 110, a living hinge molded into the material of housing 101, or a slot and pin arrangement.

In some examples, stationary portion 110 includes: (a) a wall 112 with an external surface 117; (b) a wall 113 adjacent to wall 112; (c) a wall 314 (FIG. 3) adjacent, to wall 112 and spaced apart and/or opposite wall 113; (d) a wall 115 adjacent to walls 112, 113, and 314; (e) a wall 116 adjacent to walls 113, 314, and 115 and spaced apart and/or opposite wall 112. In various embodiments, walls 112, 113, 314, 115, and/or 116 can form a part of exterior 104. Cover 120 can be hingedly attached to at least one of walls 113, 314, and 116.

In non-illustrated examples, stationary portion 110 can have other shapes or numbers of walls. For example, stationary portion could include one wall having a dome shape and a second wall forming a floor of the stationary portion. In yet another example, stationary portion 110 could have a first wall with support mechanism 111 and a second wall spaced apart from the first wall. The first and second wall could be coupled using many designs not illustrated herein.

In some embodiments, wall 112 is configured to hold electrical device 150 at external surface 117. Electrical device 150 can remain on wall 112 while a user moves cable management device 100 between the open and closed configurations to remove, add, or adjust cable 107. In the same or different embodiment, wall 112 can be at an angle with respect to wall 116. In some examples, the angle is between approximately zero and sixty degrees. In one embodiment, the angle is approximately twenty degrees.

Support mechanism 111 can be located at external surface 117 and configured to hold electrical device 150 to external surface 117. In some examples, support mechanism 111 can include at least one of: (a) one or more ridges; and (b) one or more grooves. For example, electrical device 150 can be placed in grooves or slots at external surface 117 to hold electrical device 150 in place. In the same or different example, support mechanism 111 can include a ridge at external surface 117 to support electrical device 150. In yet further embodiments, external surface 117 could be designed to have a high-friction surface. The high-friction surface could be support mechanism 111. A high-friction surface could be defined as a surface with suitable friction to hold at least one of a mobile phone, a PDA, or an MP3 player stationary on external surface 117. In some embodiments, support mechanism 111 could be a patterned or roughened external surface 117.

Referring again to FIGS. 1-3, cover 120 can include: (a) a wall or section 121 forming a portion of exterior 104; and (b) a wall or section 122 located in interior space 102 when housing 101 is in the closed configuration. In some embodiments, section 121 and section 122 can be coupled to form an L-shaped component. In the same or different embodiments, a height of section 121 can be less than a height of section 122. In some examples, section 121 is coupled to section 122 at a junction point (e.g., junction 131) and cover 120 is coupled to hinge 130 at the same junction point.

In various examples, section 121 is coupled to section 122 at junction 131 such that section 121 is substantially perpendicular to section 122 In one embodiment, "substantially perpendicular" means ninety degrees plus or minus three degrees. In another embodiment, substantially perpendicular means an angle between eighty degrees and a hundred and ten degrees. Moreover, in some embodiments, an "L-shaped" means that a first section (e.g., section 121) is substantially perpendicular to a second section (e.g., section 122). In yet other embodiments, "L-shaped" means that the first section is at non-zero (or non-one hundred and eight) degree angle with respect second section.

Section 121 can have an external surface 323 (FIG 3) at exterior 104 and an interior surface 125 opposite external surface 323. In some embodiments, electrical outlets 106 are located at interior surface 125. Electrical outlets 106 can be in interior space 102 when cover 120 is in the closed configuration.

As illustrated in FIG. 3, section 121 can include (a) an end 326 coupled to hinge 130; and (b) an end 327 opposite end 326. In some embodiments, end 326 is hingedly attached to stationary portion 110. Housing 101 is configured such that an aperture or gap 305 exists between end 327 and stationary portion 110 when cover 120 is in the closed configuration. Gap 305 provides access to interior space 102 when housing 101 is in the closed configuration. Furthermore, gap 305 allows cable 107 to pass between interior space 102 and exterior 104 when cover 120 is in the closed configuration.

Referring again to FIG. 1, housing 101 can include one or more apertures 103 in addition to or in place of gap 305. Apertures 103 can provide access to interior space 102 from exterior 104 when cover 120 is in the closed configuration. Housing 101 can be configured such that each of apertures 103 provide access to electrical outlets 106 and allow cable 107 to enter interior space 102 when cover 120 is in the closed configuration. In the embodiment disclosed in FIGS. 1-3, apertures 103 are located in stationary portion 110, but in a different embodiment, one or more of aperture 103 can be located in section 121 of cover 120 in addition to or in place of being located in stationary portion 110.

In non-illustrated embodiments, housing 101 does not include apertures 103 and a user can only access interior space 102 through gap 305 when housing 101 is in the closed configuration. In yet another embodiment, housing 101 does not include gap 305. That is, the height of section 121 is only slightly less than the height of at least a portion of wall 113. In this embodiment, a user can access interior space 102 through apertures 103 when housing 101 is in the closed configuration.

Housing 101 is preferably made of a material that is tough, hard, and rigid, has good chemical resistance and dimensional stability, exhibits good creep resistance, and is relatively strong and inexpensive. Accordingly, housing 101 can be constructed of acrylonitrile butadiene styrene (ABS), polycarbonate, polypropylene, polyethylene, or a similar material, all of which, to varying degrees, exhibit the stated properties. In one embodiment, cable management device 100 is made using one or more injection molding processes. In other embodiments, at least a portion of housing 101 is non-plastic (e.g., metal or rubber). In the same or different embodiment, cover 120 can be made from materials different than the material used in stationary portion 110.

In some embodiments, electrical connector 160 is either a two or three prong alternating current (AC) plug. In other embodiments electrical connector 160 is a direct current (DC) connector. In one example, electrical connector 160 is a DC car adapter.

In the same or different embodiment, cable management device 100 includes a surge protector. The surge protector can be electrically coupled between electrical connector 160 and electrical outlets 106, or the surge protector can be contained within section 121 of cover 120.

Figure 4:
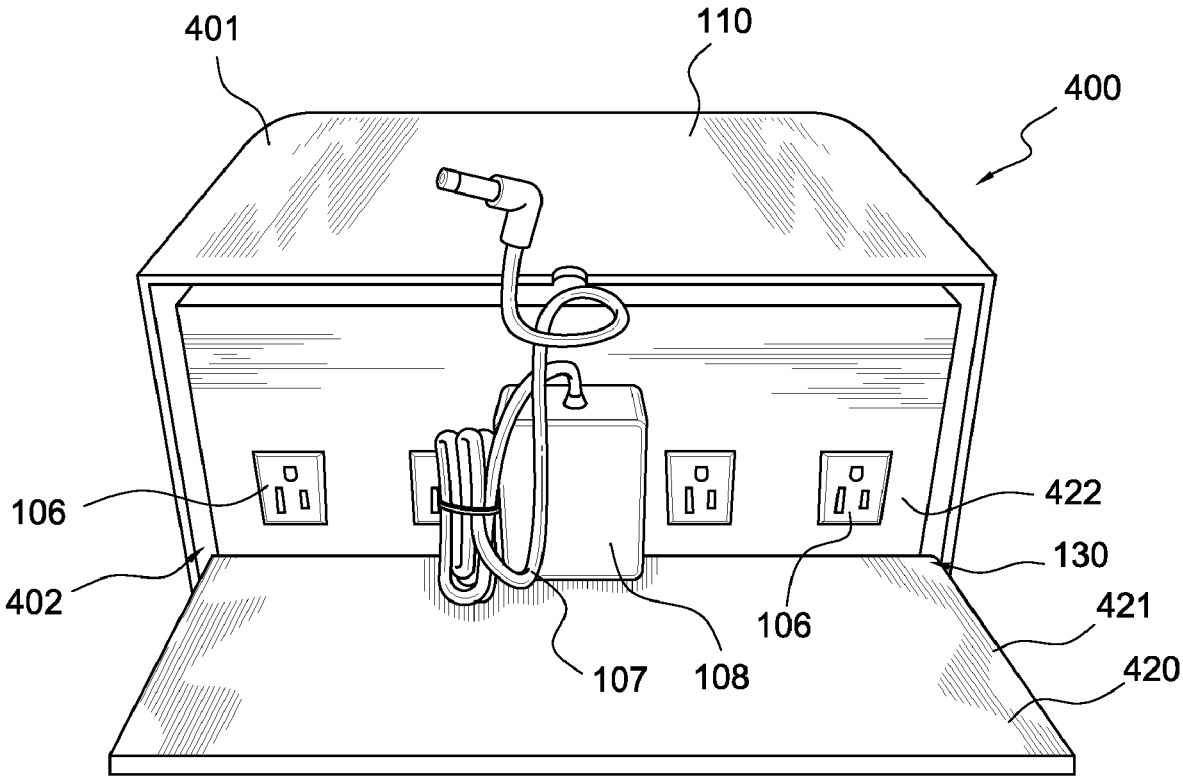
FIG. 4 illustrates a front, top isometric view of a cable management device in an open configuration, according to a second embodiment.

Turning to another embodiment, FIG. 4 illustrates a front, top isometric view of a cable management device 400, according to a second embodiment. In this embodiment, cable management device 400 can have a housing 401 defining an interior space 402. Housing 401 can include: (a) stationary portion 110; (b) cover 420; and (c) hinge 130 coupling cover 420 to stationary portion 110.

Cover 420 can include: (a) a section 421; and (b) a section 422. Section 421 can be coupled to section 422 similar to the coupling of section 121 to section 122 in FIG 1. That is, section 421 can be substantially perpendicular to section 422 in some embodiments. However, in the embodiment illustrated in FIG. 4, electrical outlets 106 are located at section 422. In a non-illustrated embodiment, electrical outlets 106 can be located at both section 421 and section 422.

Figure 5:
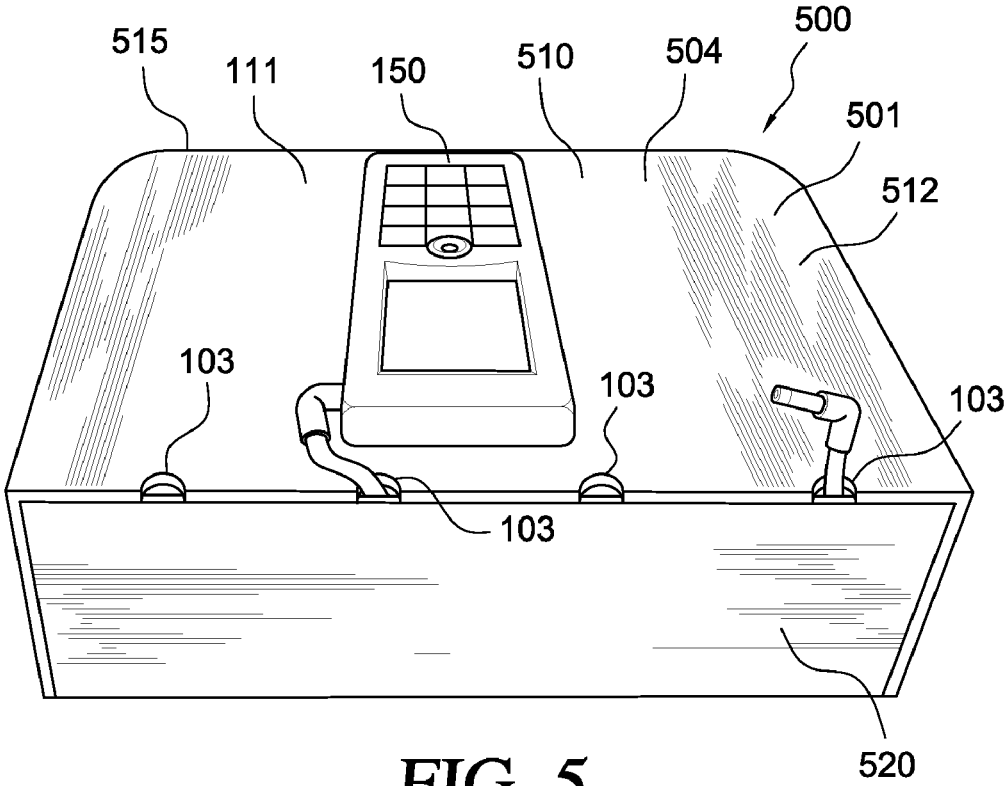
FIG. 5 illustrates a top, front isometric view of a cable management device in a closed configuration and supporting the electrical device of FIG. 1, according to a third embodiment.
Figure 6:
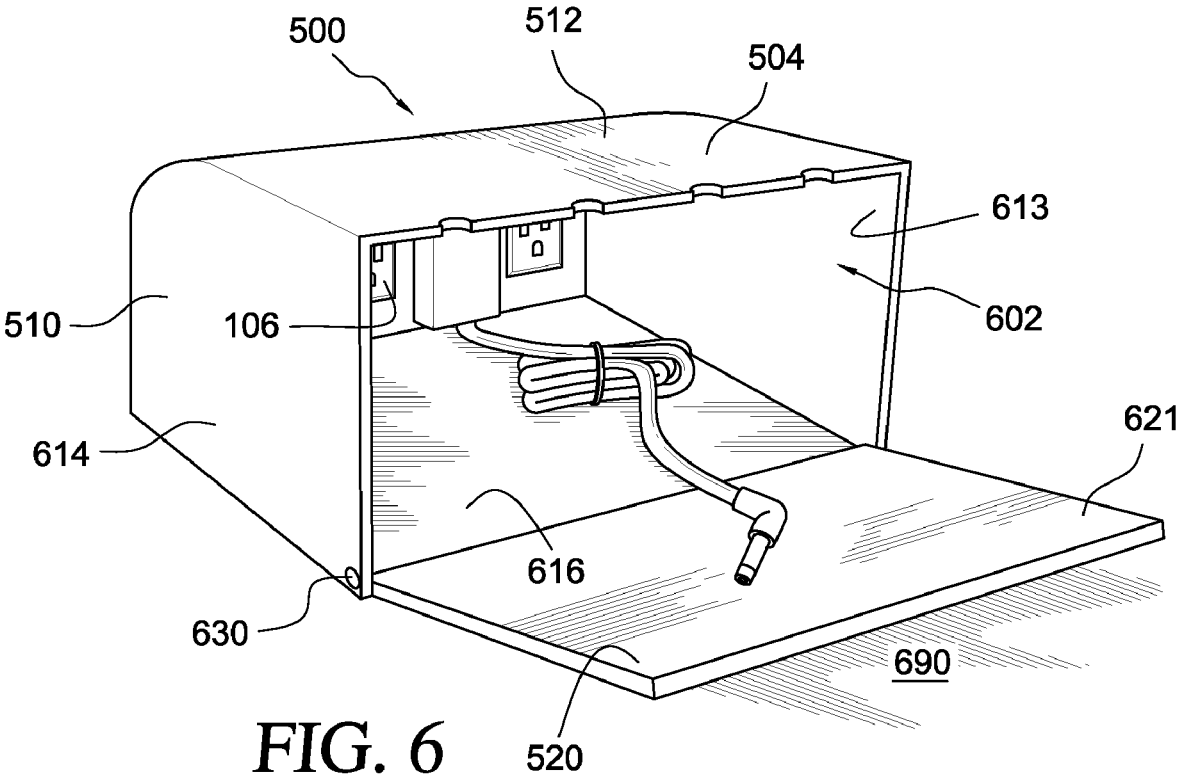
FIG. 6 illustrates a top, front, side isometric view of the cable management device of FIG. 5 in an open configuration, according to the third embodiment.

Turning to another embodiment, FIG. 5 illustrates a top, front isometric view of a cable management device 500 in a closed configuration and supporting electrical device 150, according to a third embodiment. FIG. 6 illustrates a top, front, side isometric view of a cable management device 500 in an open configuration, according to the third embodiment.

In some embodiments, a cable management device 500 can include: (a) a housing 501 defining an interior space 602 (FIG. 6) and having one or more apertures 103 extending from an exterior 504 of housing 501 to interior space 602; (b) one or more electrical outlets 106 located in interior space 602. Cable management device 500 can be configured to support electrical device 150.

Housing 501 can include: (a) a stationary portion 510 with a support mechanism 111 configured to support electrical device 150; (b) a cover 520 coupled to stationary portion 510; and (c) a hinge 630 (FIG. 6) coupling cover 520 to stationary portion 510. In some examples, cover 520 is coupled to stationary portion 510 at a junction 531. Hinge 630 couples cover 520 to stationary portion 510 such that cover 520 and electrical outlets 106 can be pivoted in relation to stationary portion 510 between the closed configuration and the open configuration. In some examples, cover 520, hinge 630, and stationary portion 510 can have a unitary structure and/or be integrally formed.

In some examples, stationary portion 510 includes: (a) a wall 512; (b) a wall 613 (FIG. 6) adjacent to wall 512; (c) a wall 614 (FIG. 6) adjacent to wall 512 and spaced part and/or opposite wall 613; (d) a wall 515 adjacent to walls 512, 613, and 614; (e) a wall 616 (FIG. 6) adjacent to walls 613, 614, and 515 and spaced apart and/or opposite wall 512. In various embodiments, walls 512, 613, 614, 515, and/or 616 can form exterior 504 of cable management device 500. Cover 520 can be hingedly attached to at least one of walls 613, 614, and 616. In some examples, cover 520 can include a wall 621. In some examples, wall 621 is spaced apart from wall 515.

In the embodiment illustrated in FIG. 6, electrical outlets 106 can be located at wall 515. In one example, electrical outlets have a vertical orientation with respect to surface 690. In non-illustrated examples, electrical outlets 106 can have a horizontal orientation or be located at least at one of wall 613 or wall 614.

Figure 7:
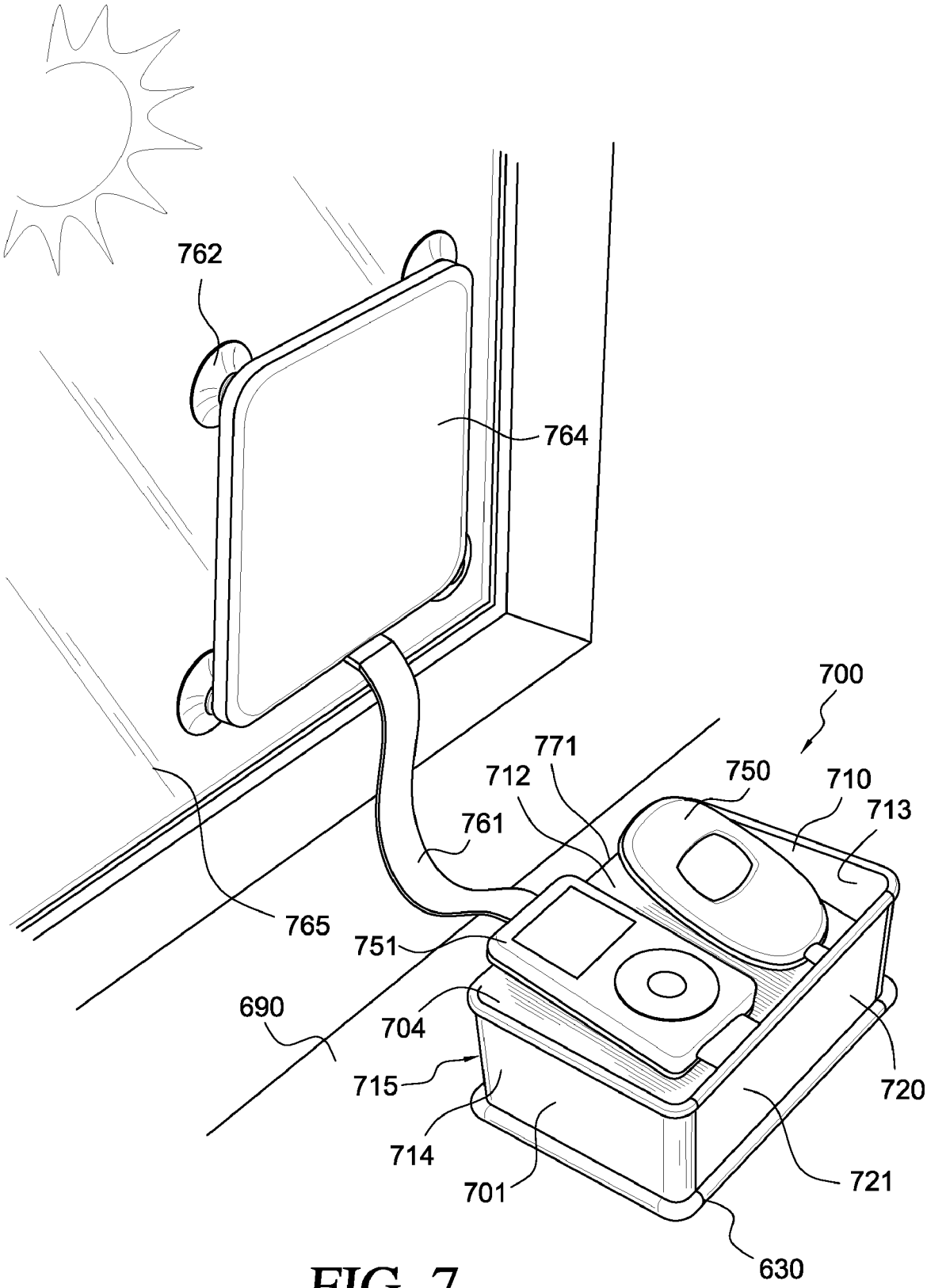
FIG. 7 illustrates a top, front, side isometric view of a cable management device in a closed configuration and holding electrical devices, according to a fourth embodiment.
Figure 8:
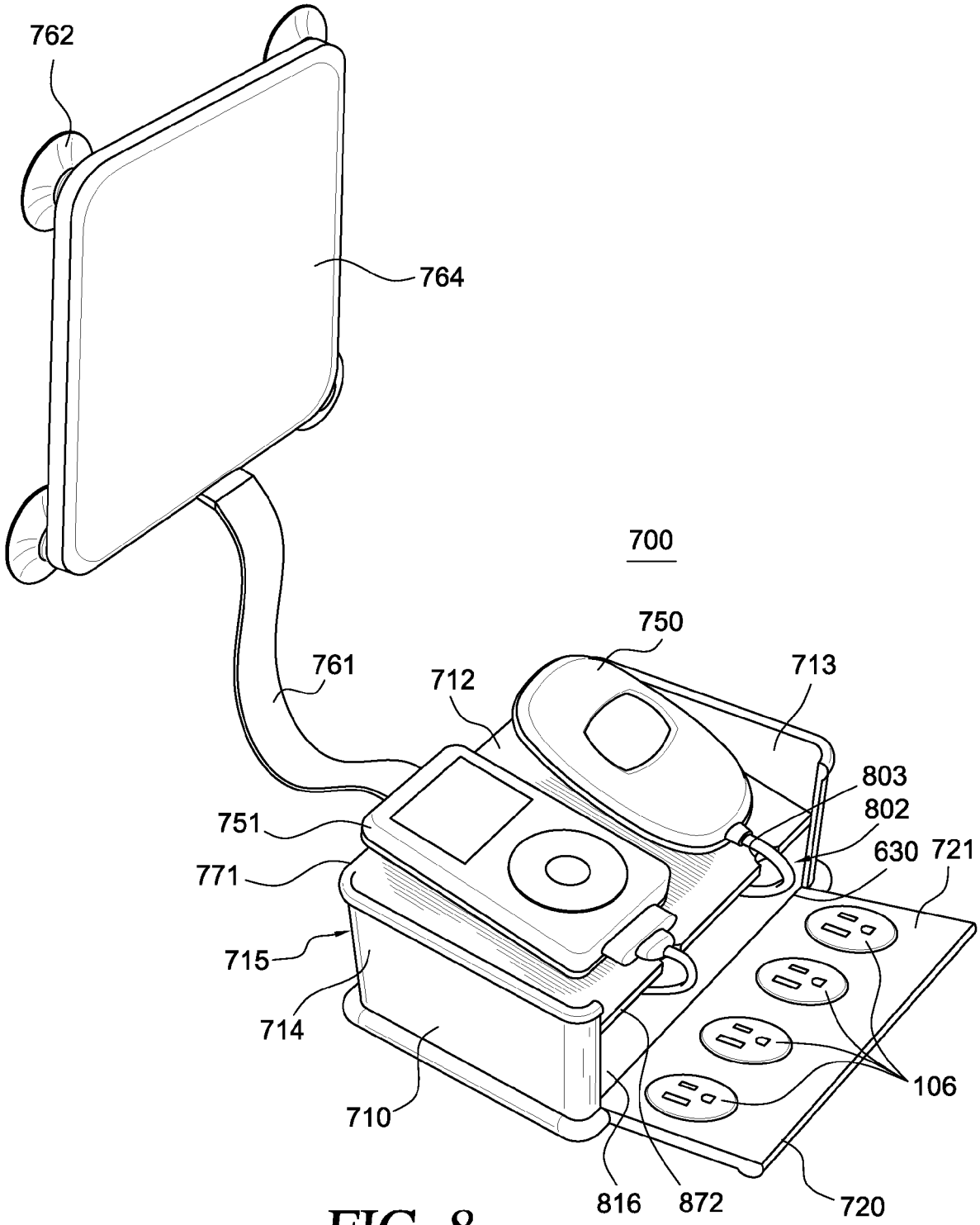
FIG. 8 illustrates a top, front, side isometric view of the cable management devices of FIG. 7 in an open configuration and holding the electrical device of FIG. 7, according to the fourth embodiment.

FIG. 7 illustrates a top, front, side isometric view of a cable management device 700 in a closed configuration and holding electrical devices 750 and 751, according to a fourth embodiment. FIG. 8 illustrates a top, front, side isometric view of cable management device 700 in an open configuration and holding electrical devices 750 and 751, according to the fourth embodiment.

As illustrated in FIGS. 7 and 8, a cable management device 700 can include: (a) a housing 701 defining an interior space 802 (FIG. 8) and having one or more apertures 803 extending from an exterior 704 of housing 701 to interior space 802; (b) one or more electrical outlets 106; (c) one or more solar panels 764; and (e) at least one cable 761 electrically coupling solar panels 764 to electrical outlets 106. Cable management device 700 can be configured to support electrical devices 750 and 751. Electrical devices 750 and 751 can be identical or similar to electrical device 150 (FIG. 1).

Housing 701 can include: (a) a stationary portion 710, (b) a cover 720 coupled to stationary portion 710; and (c) hinge 630 coupling cover 720 to stationary portion 710. Hinge 630 couples cover 720 to stationary portion 710 such that cover 720 and electrical outlets 106 can be pivoted in relation to stationary portion 710 between a closed configuration and an open configuration. Electrical outlets 106 can be located in interior space 702 when housing 701 is in the closed configuration.

In some examples, stationary portion 710 includes: (a) a wall 712 with a end 771 and an end 872 (FIG. 8) opposite end 771; (b) a wall 713 adjacent to wall 712; (c) a wall 714 adjacent to wall 712 and spaced part and/or opposite wall 713; (d) a wall 715 adjacent to walls 712, 713, and 714; (e) a wall 816 (FIG. 8) adjacent to walls 713, 714, and 715 and spaced apart and/or opposite wall 712. In various embodiments, walls 712, 713, 714, 715, and/or 816 can form exterior 704.

Cover 720 can be hingedly attached to at least one of walls 713, 714, and 816. In some examples, cover 720 can include a wall 721. In some examples, wall 721 is spaced apart from wall 715. In these embodiments, electrical outlets 106 can be located at wall 721.

In non-illustrated embodiments, cover 720 can include an L-shaped portion instead of wall 721. In yet further embodiments, electrical outlets 106 can be located at least at one of walls 713, 714, 715, and 816.

In the embodiment illustrated in FIGS. 5, 7, and 8, a height of wall 712 at end 771 relative to surface 690 is greater than a height of wall 712 at end 872 relative to surface 690. That is, wall 712 is sloped between ends 771 and 872. Moreover, when housing 701 is in a closed arrangement, a height of wall 721 relative to surface 690 can be greater than the height of wall 712 at end 872 relative to surface 690.

In some examples, wall 721 can act as a support mechanism for electrical devices 750 and 751. In non-illustrated embodiments, housing 101 can include an additional support mechanism similar to support mechanism 111 (FIG. 1).

Solar panels 764 are configured to provide electrical power for electrical outlets 106. In one example, cable management device 700 can further include a rechargeable battery. In this example, solar panels 764 can electrically charge the rechargeable battery such that the rechargeable battery can provide electrical power to electrical outlets 106 when the solar panels 764 are not generating any electrical power (e.g., at night or in darkness). In some embodiments, solar panels 764 provide electrical power directly to electrical outlets 106 when solar panels 764 are generating power. In other example, solar panels 764 are coupled to the rechargeable battery and the rechargeable battery provides electrical power to electrical outlets 106.

Solar panels 764 can have one or more connection mechanisms 762. Connection mechanisms 762 can be configured to couple solar panels 764 to a window 765 or other surface. For example, connection mechanism 762 can include suction cups, adhesive patches, screws, Velcro® material, or the like.

Figure 9:
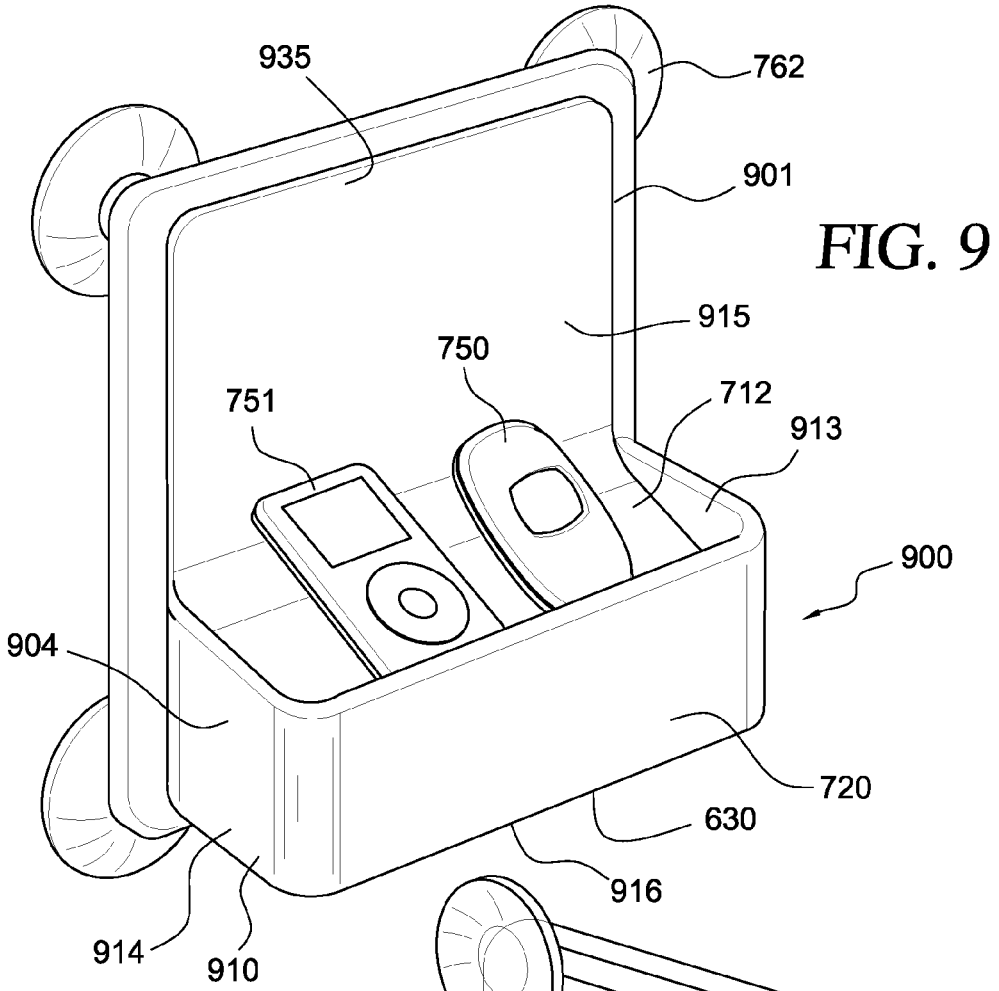
FIG. 9 illustrates a top, front, side isometric view of a cable management device in a closed configuration and holding the electrical devices of FIG. 7, according to a fifth embodiment.
Figure 10:
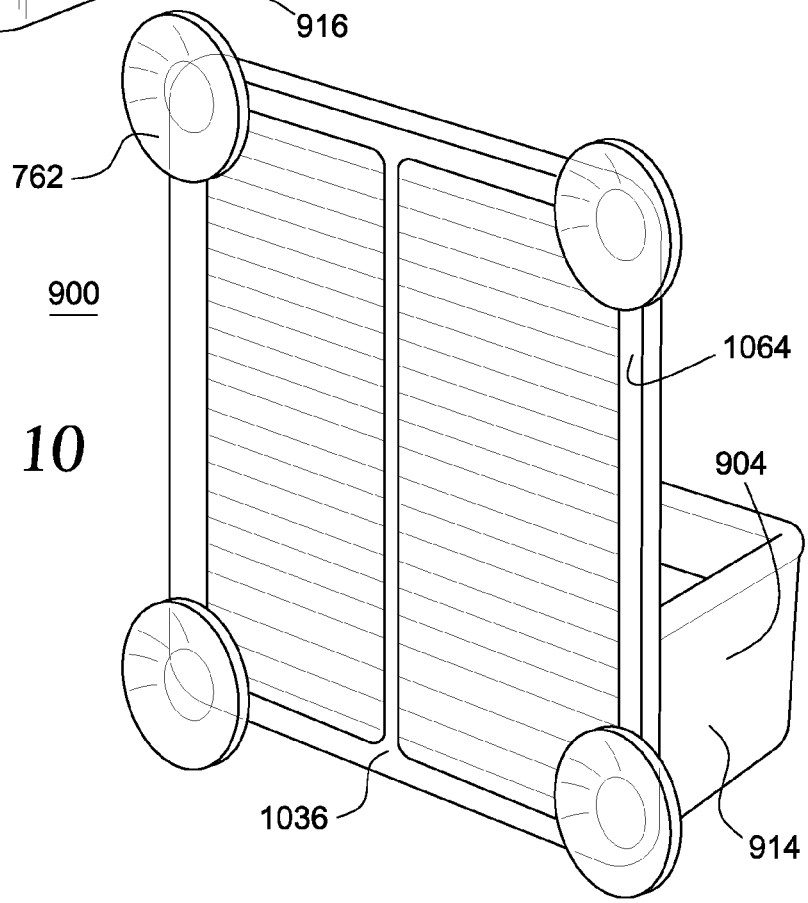
FIG. 10 illustrates a top, back, side isometric view of the cable management device of FIG. 9 in the closed configuration, according to the fifth embodiment.

Turning to another embodiment, FIG. 9 illustrates a top, front, side isometric view of a cable management device 900 in a closed configuration and holding electrical devices 750 and 751, according to a fifth embodiment. FIG. 10 illustrates a top, back, side isometric view of cable management device 900 in the closed configuration, according to the fifth embodiment.

As illustrated in FIGS. 9 and 10, a cable management device 900 can include: (a) a housing 901 defining an interior space (not shown) and having one or more apertures (not shown) extending from an exterior 904 of housing 901 to the interior space; (b) one or more electrical outlets (not shown); (c) one or more solar panels 1064 at exterior 904 and electrically coupled to the one or more electrical outlets. Cable management device 900 can be configured to support electrical devices 750 and 751.

Housing 901 can include: (a) a stationary portion 910; (b) cover 720 hingedly coupled to stationary portion 910; and (c) hinge 630 coupling cover 720 to stationary portion 910.

In some examples, stationary portion 910 includes: (a) wall 712; (b) a wall 913 adjacent to wall 712; (c) a wall 914 adjacent to wall 712 and spaced part and/or opposite wall 913; (d) a wall 915 have a side 935 and a side 1036 (FIG. 10) opposite side 935 and adjacent to walls 712, 913, and 914; (e) a wall 916 adjacent to walls 913, 914, and 915 and spaced apart and/or opposite wall 712. Cover 720 can be hingedly attached to at least one of walls 913, 914, and 916.

In the embodiments illustrated in FIGS. 9 and 10, a height of wall 915 is greater than the heights of wall 913, wall 914, and cover 720. Solar panels 1064 and connection mechanisms 762 can be located at side 1036. In other embodiments, all of wall 915 can be part of solar panels 764.

Figure 11:
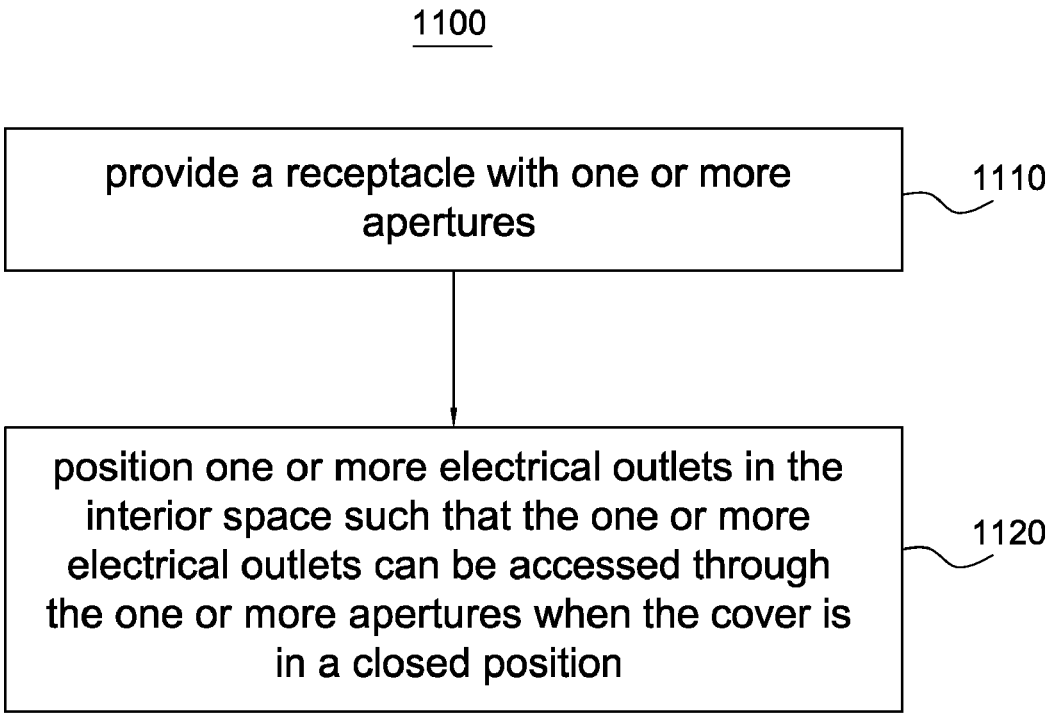
FIG. 11 illustrates a flow chart for an embodiment of a method of providing a cable management device.

FIG. 11 illustrates a flow chart 1100 for an embodiment of a method of providing a cable management device. As an example, the cable management device can be similar or identical to cable management devices 100, 400, 500, 700, or 900 of FIGS. 1, 4, 5, 7, and 9 respectively.

Flow chart 1100 includes a step 1110 of providing a receptacle with one or more apertures. For example, the receptacle can be identical or similar to housing 101, 401, 501, 701, or 901 of FIGS. 1, 4, 5, 7, and 9, respectively. The one or more apertures can be identical or similar to apertures 103 or 803 of FIGS. 1 and 8, respectively, or gap 305 of FIG. 3.

Figure 12:
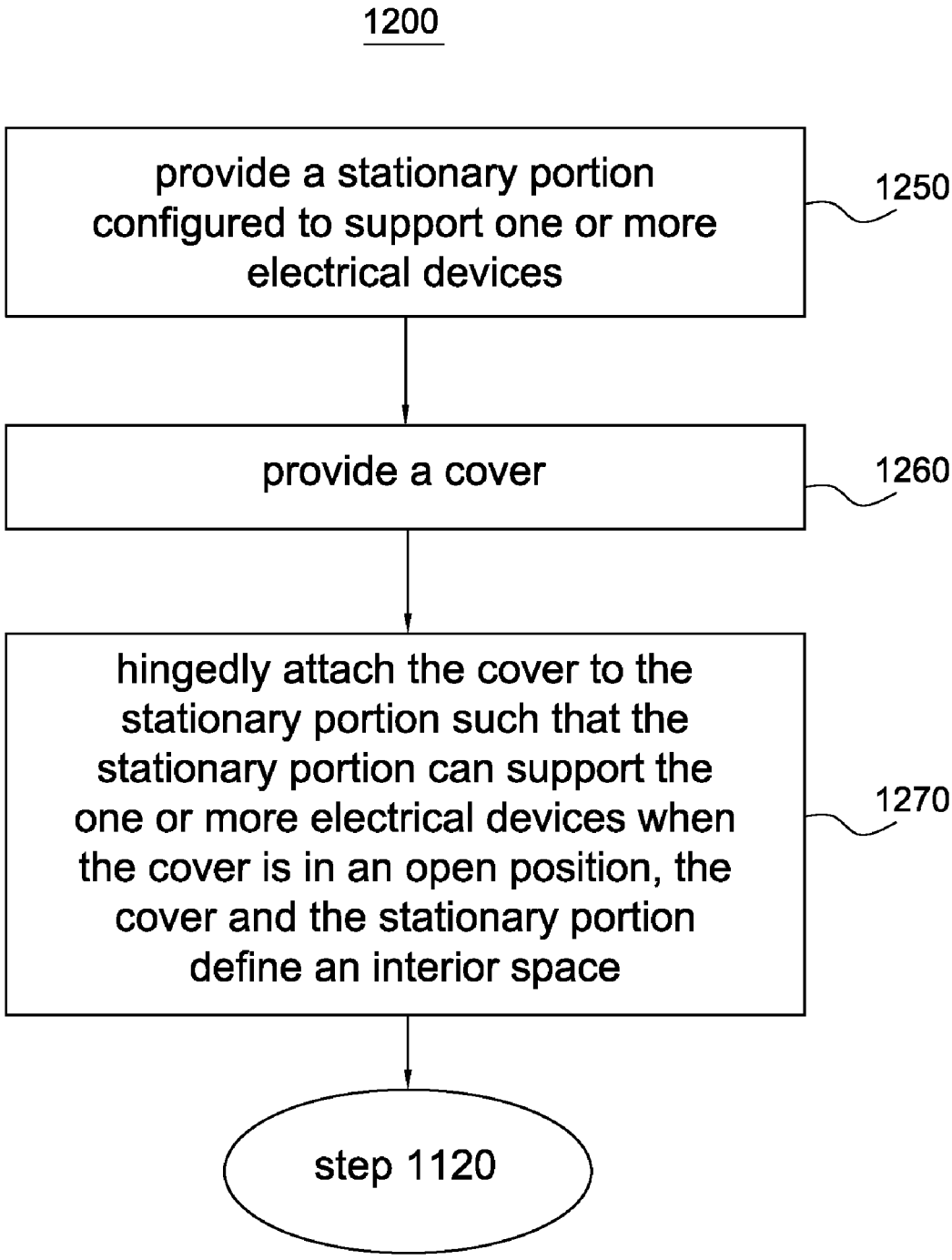
FIG. 12 illustrates a flow chart of a step of providing a receptacle with one or more apertures, according to an embodiment.

FIG. 12 illustrates a flow chart 1200 of step 1110 (FIG. 11) of providing a receptacle with one or more apertures, according to an embodiment. Flow chart 1200 of FIG. 12 includes a procedure 1250 of providing a stationary portion configured to support one or more electrical devices. For example, the stationary portion can be identical or similar to stationary portion 110, 510, 710, or 910 of FIGS. 1, 5, 7, and 9, respectively. The one or more electrical devices can be identical or similar to electrical device 150 as shown in FIGS. 1, 2, and 5 or electrical devices 750 and 751 as shown in FIGS. 7-9.

Subsequently, flow chart 1200 of FIG. 12 includes a procedure 1260 of providing a cover. For example, the cover can be identical or similar to cover 120, 420, 520, or 720 of FIGS. 1, 4, 5, and 7, respectively.

Subsequent, flow chart 1200 of FIG. 12 includes a procedure 1270 of hingedly attaching the cover to the stationary portion such that the stationary portion can support the one or more electrical devices when the cover is in an open position, and with the cover and the stationary portion defining an interior space. For example, the cover hingedly coupled to the stationary portion can be similar or identical to coupling of the cover and the stationary portion as shown in FIGS. 1-10. After procedure 1270 of FIG. 12, step 1110 is complete, and the next step in flow chart 1100 (FIG. 11) is step 1120.

Turning back to FIG. 11, flow chart 1100 includes step 1120 of positioning one or more electrical outlets in the interior space such that the one or more electrical outlets can be accessed through the one or more apertures when the cover is in a closed position. The positioning of the one or more electrical outlets can be identical or similar to the positioning of electrical outlets 106 as shown in FIGS. 1, 4, 6, or 8.

Figure 13:
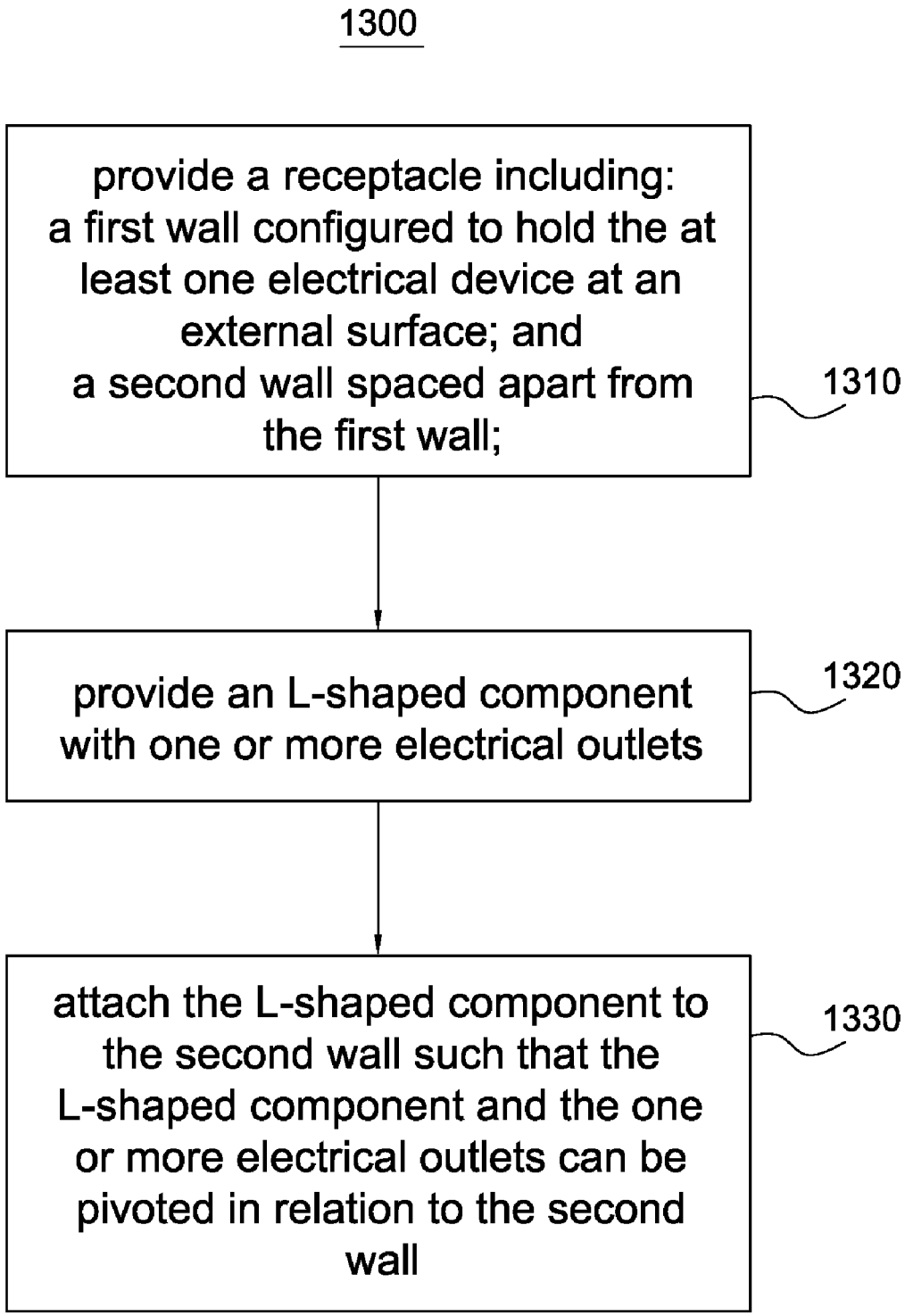
FIG. 13 illustrates a flow chart for an embodiment of a method of providing a holder.

Turning to another method, FIG. 13 illustrates a flow chart 1300 for an embodiment of a method of providing a holder. For example, the holder can be similar or identical to cable management device 100 or 400 as shown in FIGS. 1 and 4, respectively.

Flow chart 1300 of FIG. 13 includes a step 1310 of providing a receptacle including: (a) a first wall configured to hold the at least one electrical device at an external surface; and (b) a second wall spaced apart from the first wall. In one example, the first wall can be identical or similar to wall 112 of FIG. 1. The second wall can be identical or similar to wall 116 of FIG. 1.

Flow chart 1300 in FIG. 13 continues with a step 1320 of providing an L-shaped component with one or more electrical outlets. For example, the L-shaped component can be identical or similar to cover 120 or 420 of FIGS. 1 and 4, respectively. The one or more electrical outlets can be similar or identical to electrical outlets 106 of FIGS. 1 and 4.

Subsequently, flow chart 1300 includes a step 1330 of attaching the L-shaped component to the second wall such that the L-shaped component and the one or more electrical outlets can be pivoted in relation to the second wall. For example, the coupling of the L-shaped component and the second wall can be similar or identical to the coupling of cover 120 or 420 with wall 116 as shown in FIGS. 1 and 4.

Figure 14:
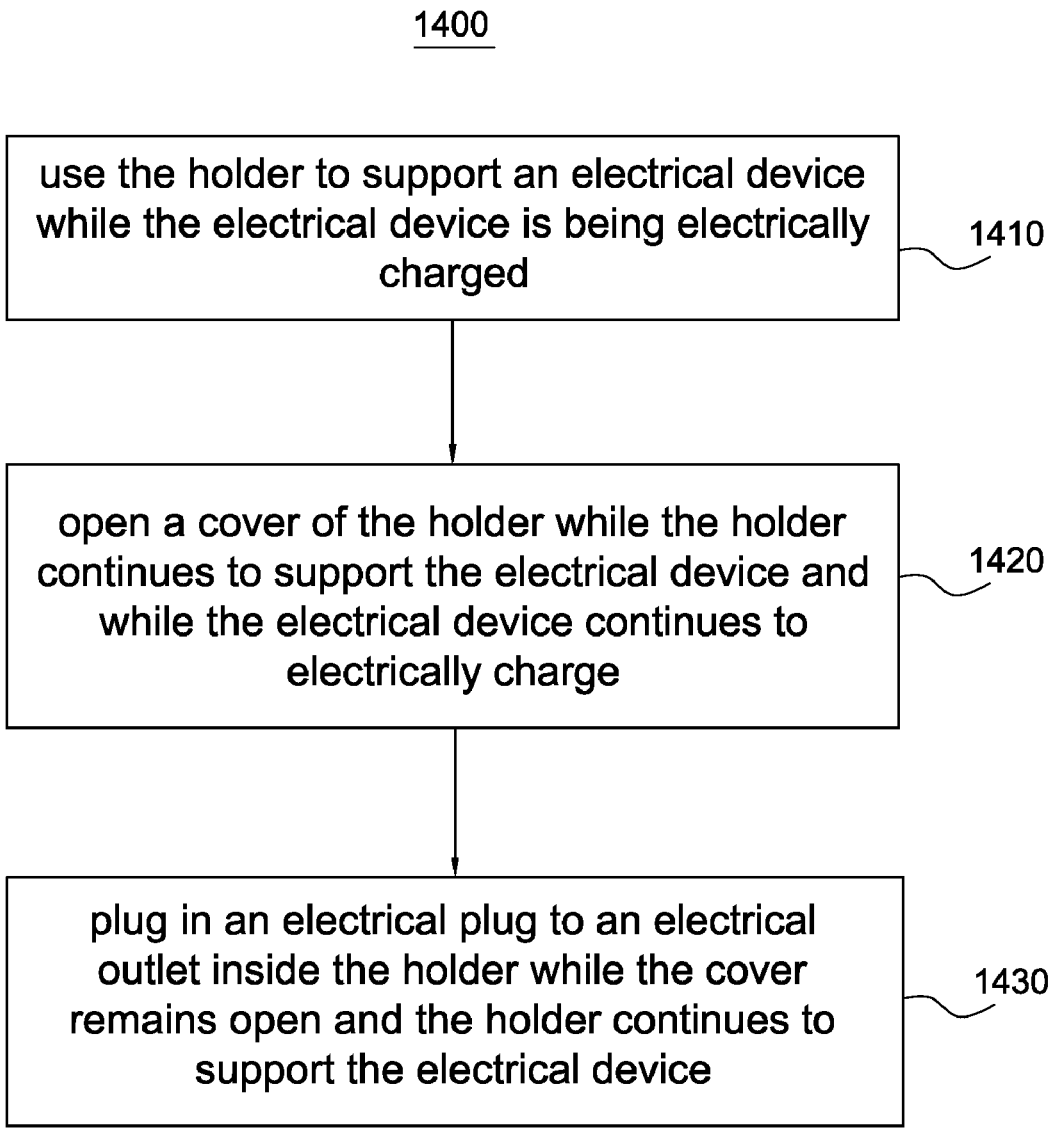
FIG. 14 illustrates a flow chart for an embodiment of a method of using a holder.

Turning to yet another example, FIG. 14 illustrates a flow chart 1400 for an embodiment of a method of using a holder. For example, the holder can be identical or similar to the cable management device 100, 400, 500, 700, or 900 as shown in FIGS. 1, 4, 5, 7, and 9, respectively.

Flow chart 1400 of FIG. 14 includes a step 1410 of using the holder to support an electrical device while the electrical device is being electrically charged. For example, the electrical device can be identical or similar to electrical device 150 as shown in FIGS. 1, 2, and 5 or electrical devices 750 and 751 as shown in FIGS. 7-9.

Subsequently, flow chart 1400 of FIG. 14 includes a step 1420 of opening a cover of the holder while the holder continues to support the electrical device and while the electrical device continues to electrically charge.

Next, flow chart 1400 of FIG. 14 includes a step 1430 of plugging in an electrical plug to an electrical outlet inside the holder while the cover remains open and the holder continues to support the electrical device.

Although the invention has been described with reference to specific embodiments, it will be understood by those skilled in the art that various changes may be made without departing from the spirit or scope of the invention. For example, it will be readily apparent that electrical outlets 106 could be replaced or supplemented with other types of connectors such as universal serial bus (USB) connectors, RJ11 (telephone) connectors, direct current (DC) power connectors, and the like. In other examples, instead of electrical outlets 106, the cable management device can have an electrical cable configured to couple to electrical devices 150, 750, and/or 751. In some embodiments, the electrical cable can have a universal connector or a set of interchangeable connectors to allow the cable management device to connect to many different electrical devices.

Additional examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. To one of ordinary skill in the art, it will be readily apparent that the case and method of use discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A cable management device configured to rest over a substantially flat surface and support one or more electrical devices, the cable management device comprising:

a housing defining an interior space and having one or more apertures extending from an exterior of the housing to the interior space, the housing comprising:

a stationary portion; and a cover hingedly attached to the stationary portion; and one or more electrical outlets located in the interior space of the housing, wherein:

the stationary portion comprises:

a first wall with a support mechanism; and a second wall spaced apart from the first wall and configured to rest over the substantially flat surface;

the support mechanism supports the one or more electrical devices;

the cover is configured to move between a first position, in which the cover substantially encloses the interior space, and a second position, in which the interior space is exposed;

the one or more apertures provide access to the interior space from the exterior of the housing when the cover is in the first position; and the housing is configured such that the cover can be moved between the first position and the second position while the support mechanism maintains support of the one or more electrical devices and the second wall rests over the substantially flat surface.

2. The cable management device of claim 1, wherein:

the housing is configured such that the one or more electrical outlets are accessible through the one or more apertures when the cover is in the first position.

3. The cable management device of claim 1, wherein:

the cover is hingedly attached to the second wall.

4. The cable management device of claim 1, wherein:

the cover has an external surface at the exterior of the housing and an interior surface opposite the external surface; and the one or more electrical outlets are located at the interior surface of the cover.

5. The cable management device of claim 1, wherein;

the cover comprises:

a first section; and a second section located in the interior space when the cover is in the first position;

the first section comprises a portion of the exterior of the housing; and the one or more electrical outlets are located at least at the first section of the cover and in the interior space when the cover is in the first position.

6. The cable management device of claim 1, wherein:

the cover comprises:

a first section; and a second section located in the interior space when the cover is in the first position; and the first section is coupled to the second section at a first junction such that the first section is substantially perpendicular to the second section.

7. The cable management device of claim 6, wherein:

the cover is coupled to the stationary portion at the first junction.

8. The cable management device of claim 6, wherein;

the first section comprises a portion of the exterior of the housing.

9. The cable management device of claim 1, wherein:

the cover has a first end and a second end opposite the first end;

the first end of the cover is hingedly attached to the stationary portion;

the housing is configured such that a gap exists between the second end of the cover and the stationary portion when the cover is in the first position; and the gap comprises one of the one or more apertures.

10. The cable management device of claim 1, wherein:

the stationary portion further comprises a third wall spaced apart from the cover and coupled to the first wall and the second wall; and the one or more electrical outlets are located at the third wall.

11. The cable management device of claim 1, wherein:

the housing is configured such that each of the one or more apertures can allow one or more cables to enter the interior space of the housing.

12. The cable management device of claim 1, wherein:

the support mechanism comprises at least one of: an exterior surface of the housing, at least one ridge or at least one groove; and the exterior surface of the housing is part of the exterior of the housing.

13. The cable management device of claim 1, further comprising:

one or more solar panels to provide electrical power to the one or more electrical outlets.

14. The cable management device of claim 1, wherein:

the cover comprises:

a first section; and a second section located in the interior space when the cover is in the first position;

the first section comprises a portion of the exterior of the housing; and the one or more electrical outlets are located at least at the second section of the cover and in the interior space when the cover is in the first position.

15. The cable management device of claim 1, wherein:

the cover is hingedly attached to the second wall; and the housing is configured such that the cover rests over the substantially flat surface when the cover is in the second position.

16. The cable management device of claim 1, wherein:

at least a part of the cover is located between the first wall and the second wall.

17. The cable management device of claim 1, wherein:
the first wall is opposite the second wall.

18. A holder for at least one electrical device, the at least one electrical device coupled to one or more cables, the holder comprising:

a receptacle defining a cavity, the receptacle comprising:
a first wall with an external surface;
a second wall;
an L-shaped component; and
a hinge; and one or more electrical outlets located in the cavity of the receptacle, wherein:

the first wall is configured to hold the at least one electrical device at the external surface;

the hinge couples the L-shaped component to the second wall such that the L-shaped component and the one or more electrical outlets is configured to be pivoted in relation to the second wall; and the L-shaped component can be pivoted in relation to the second wall such that the receptacle can be placed in a closed arrangement and an open arrangement;

wherein: the L-shaped component comprises: a third wall; and a fourth wall coupled the third wall such that the fourth wall is substantially perpendicular to the third wall; wherein: the L-shaped component is adjacent to the first wall; the third wall has a first end and a second end opposite the first end; the first end of the third wall is coupled to the hinge; the receptacle is configured such that a gap exists between the second end of the third wall and the first wall when the receptacle is in the closed arrangement; and the gap provides access to the cavity when the receptacle is in the closed arrangement.

19. The holder of claim 18, wherein:

the one or more electrical outlets are located at least at the third wall;

the third wall is a portion of an exterior of the receptacle; and the one or more electrical outlets are located in the cavity when the receptacle is in the closed arrangement.

20. The holder of claim 18, wherein:

the third wall is a portion of an exterior of the receptacle;

the fourth wall is located in the cavity when the receptacle is in the closed arrangement; and the one or more electrical outlets are located at least at the fourth wall.

21. The holder of claim 18, further comprising:

one or more solar panels to provide electrical power to the one or more electrical outlets.

22. The holder of claim 18, wherein:

the first wall is at angle with respect to the second wall.

23. The holder of claim 18, wherein:

the L-shaped component comprises:
a third wall having a first end and a second end opposite the first end; and
a fourth wall coupled the third wall such that the fourth wall is substantially perpendicular to the third wall;

the L-shaped component is adjacent to the first wall;

a height of the fourth wall is greater than a height of the third wall;

the third wall is a portion of an exterior of the receptacle;

the fourth wall is located in the cavity;

the one or more electrical outlets are located at least at the third wall;

the first end of the third wall is coupled to the hinge;

the receptacle is configured such that a gap exists between the second end of the third wall and the first wall when the receptacle is in the closed arrangement;

the gap provides access to the cavity when the receptacle is in the closed position; and the first wall is at angle with respect to the second wall.

24. The cable management device of claim 18, wherein:

the receptacle is configured such that the L-shaped component can be moved between the open arrangement and the closed arrangement while the first wall holds the at least one electrical device at the external surface and the second wall lies over a substantially flat surface.

25. The cable management device of claim 18, wherein:

the receptacle further comprises:
a support mechanism configure to help hold the at least one electrical device at the external surface of the first wall; and
the support mechanism comprises at least one of: one or more ridges at the external surface of the first wall or one or more grooves at the external surface of the first wall.

26. The cable management device of claim 18, wherein:

the L-shaped component is located between the first wall and the second wall.

27. The cable management device of claim 18, wherein:

the first wall is opposite the second wall.

* * * * *

UNITED STATES PATENT AND TRADEMARK OFFICE

CERTIFICATE OF CORRECTION

PATENT NO. : 7,553,174 B2
APPLICATION NO. : 11/866779
DATED : June 30, 2009
INVENTOR(S) : Jon Roepke and Kenneth Mori It is certified that error appears in the above-identified patent and that said Letters Patent is hereby corrected as shown below:

At column 13, line 17, delete "can" and insert --is configured to--.

Signed and Sealed this

Twenty-seventh Day of October, 2009

David J. Kappos

David J. Kappos
*Director of the United States Patent and Trademark Office*